US009422937B2

(12) United States Patent
Shirinov et al.

(10) Patent No.: US 9,422,937 B2
(45) Date of Patent: Aug. 23, 2016

(54) VACUUM PUMP

(71) Applicant: Pfeiffer Vacuum GmbH, Asslar (DE)

(72) Inventors: Aleksandr Shirinov, Wetzlar (DE); Tobias Stoll, Hohenahr (DE); Michael Schweighoefer, Schoeffengrund (DE); Jan Hofmann, Gruenberg (DE)

(73) Assignee: Pleiffer Vacuum GmbH, Asslar (DE)

( * ) Notice: Subject to any disclaimer, the term of this patent is extended or adjusted under 35 U.S.C. 154(b) by 796 days.

(21) Appl. No.: 13/766,918

(22) Filed: Feb. 14, 2013

(65) Prior Publication Data

US 2013/0224001 A1 Aug. 29, 2013

(30) Foreign Application Priority Data

Feb. 23, 2012 (DE) ..... 10 2012 003 680
Oct. 15, 2012 (EP) ..... 12188584

(51) Int. Cl.

| | |
|---|---|
| ***F04D 3/00*** | (2006.01) |
| ***F04D 19/04*** | (2006.01) |
| ***F04D 23/00*** | (2006.01) |
| ***F04D 17/16*** | (2006.01) |

(52) U.S. Cl.

CPC ..... *F04D 3/00* (2013.01); *F04D 17/168* (2013.01); *F04D 19/046* (2013.01); *F04D 23/008* (2013.01)

(58) Field of Classification Search

CPC ..... F04D 17/168
USPC ..... 417/423.4; 415/90, 143
See application file for complete search history.

(56) References Cited

U.S. PATENT DOCUMENTS

| | | | | |
|---|---|---|---|---|
| 5,020,969 | A | 6/1991 | Mase | |
| 5,848,873 | A | 12/1998 | Schofield | |
| 5,893,702 | A * | 4/1999 | Conrad | F04D 19/046 415/71 |
| 6,779,969 | B2 | 8/2004 | Nonaka | |
| 7,896,625 | B2 | 3/2011 | Schofield | |
| 2006/0140794 | A1 | 6/2006 | Schoefield | |
| 2006/0140795 | A1 | 6/2006 | Schofield | |
| 2006/0153715 | A1 | 7/2006 | Schoefield | |
| 2007/0081893 | A1 * | 4/2007 | Huntley | F04D 19/042 415/229 |
| 2008/0193303 | A1 * | 8/2008 | Stones | F04D 19/042 417/251 |
| 2013/0224000 | A1 | 8/2013 | Porte et al. | |
| 2014/0369807 | A1 | 12/2014 | Stones | |

FOREIGN PATENT DOCUMENTS

| | | | | |
|---|---|---|---|---|
| EP | 2813710 | | 12/2014 | |
| JP | 2585420 | B2 * | 2/1997 | F04D 17/168 |
| JP | 11131198 | | 11/1999 | |
| JP | 4579356 | B2 * | 11/2010 | F04D 17/168 |
| JP | 2010265894 | | 11/2010 | |
| WO | 2005033520 | | 4/2005 | |

OTHER PUBLICATIONS

Search Report of German Patent and Trademark Office.

* cited by examiner

*Primary Examiner* — Nathaniel Wiehe
*Assistant Examiner* — Woody A Lee, Jr.
(74) *Attorney, Agent, or Firm* — Abelman, Frayne & Schwab

(57) ABSTRACT

The invention relates to a vacuum pump having at least one molecular pump stage, in particular a Holweck stage, which includes a rotor member which forms the pump-active surface of the molecular pump stage and having at least one side channel pump stage which is arranged downstream of the molecular pump stage and which includes a plurality of rotor elements, wherein the rotor elements of the side channel pump stage are supported by the rotor member of the molecular pump stage. The invention further relates to a vacuum pump having at least one molecular pump stage, in particular a Holweck stage, and having at least one side channel pump stage which is arranged downstream of the molecular pump stage and which includes a plurality of rotor elements, wherein the side channel pump stage is arranged between a pump inlet and the molecular pump stage.

18 Claims, 5 Drawing Sheets

VACUUM PUMP

Figure 1:
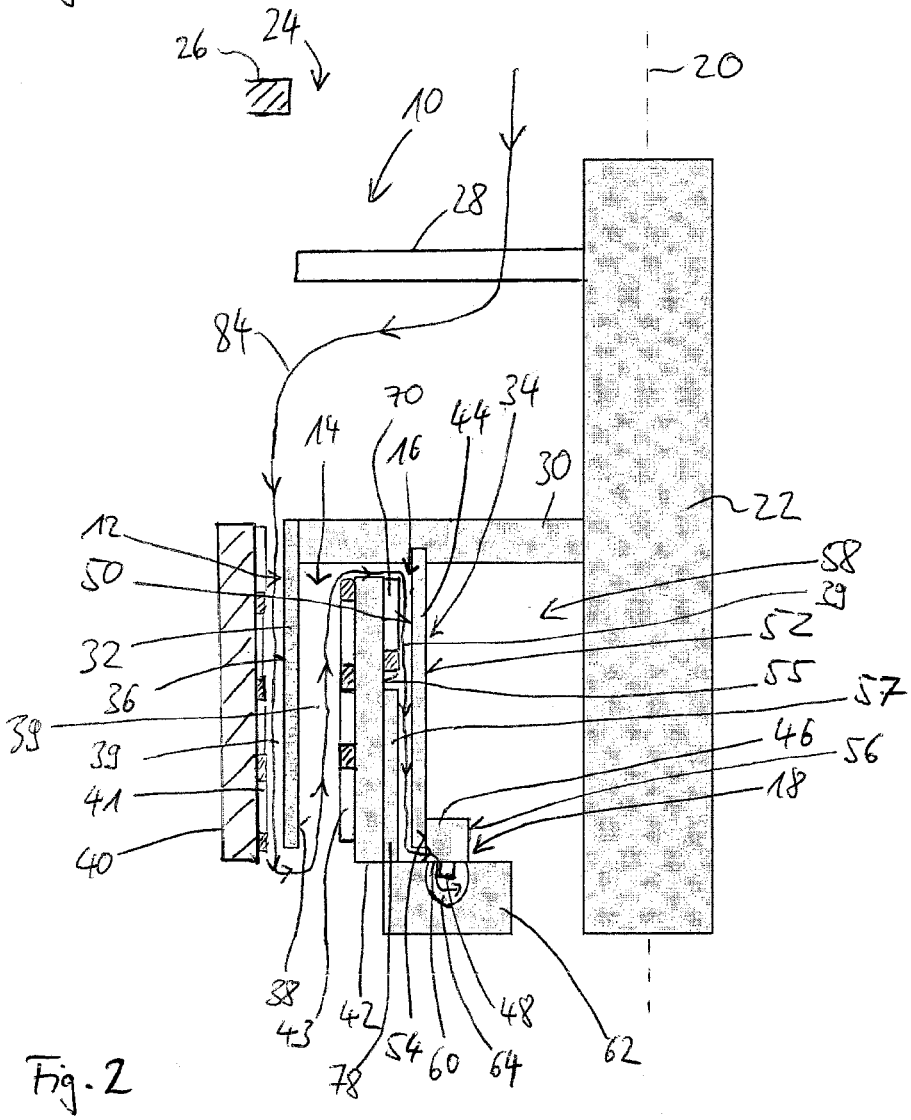

The present invention relates to a vacuum pump having at least one molecular pump stage, in particular a Holweck stage, and having at least one side channel pump stage arranged downstream of the molecular pump stage.

Vacuum pumps which have an additional side channel pump stage downstream of a molecular pump stage are known in principle. The side channel pump serves to improve the pumping behavior of the vacuum pump, in particular in the working ranges of the vacuum pump in which particularly high roughing pressures, high inlet pressures or high gas loads occur, and to reduce the power consumption of the vacuum pump in these working ranges. The side channel pump stage implements a pumping principle which is optimized for use with higher gas pressures and in particular also allows an energy-efficient pump operation in the laminar flow region, that is in the pressure range disposed above the molecular flow region. The achievable exit pressure and the achievable intake performance of the vacuum pump are therefore increased by the side channel pump stage arranged downstream of the molecular pump stage and the power consumption of the vacuum pump is simultaneously kept low.

Different construction solutions have been proposed for the integration of a side channel pump stage and of a molecular pump stage in a common vacuum pump. A vacuum pump is, for example, known from EP 1 668 255 A1 in which a pump stage which is similar to a side channel pump stage is arranged, including its rotor elements and its stator, within a Holweck sleeve of a molecular pump stage. The Holweck sleeve and the rotor elements of the inwardly disposed pump stage are in this respect arranged on a common rotor hub, with the rotor elements of the inwardly disposed pump stage being arranged radially inwardly offset with respect to the Holweck sleeve.

The achievable pump power of the inwardly disposed pump stage is restricted in this embodiment due to the radially inwardly disposed arrangement of the rotor elements and due to the correspondingly relatively small radius of rotation, whereby the achievable exit pressure and the intake performance of the pump are reduced and their power consumption are increased. The inwardly disposed rotor elements and the corresponding stator of the inwardly disposed pump stage extending into the interior of the Holweck sleeve furthermore take up valuable construction space which is not available for other pump components, whereby the dimensions of the pump are increased. In addition, the rotor elements of the inwardly disposed pump stage and the associated stator are nested with the Holweck sleeve and the associated Holweck stator and are only accessible from the outside with difficulty due to their arrangement within the Holweck sleeve, whereby the manufacturing and assembly effort required for the manufacture of the pump is increased and the implementation of a cooling device, for example, for the effective cooling of the corresponding components is made more difficult in the operation of the vacuum pump.

It is the object of the invention to provide a vacuum pump which has an increased exit pressure and an increased intake power, which can be operated under any desired operating conditions with a low energy consumption and which can simultaneously be implemented in a small construction space and with a small manufacturing and assembly effort.

This object is satisfied by a vacuum pump having the features of claim 1 and by a vacuum pump having the features of claim 10.

The vacuum pump in accordance with claim 1 forms a first subject of the invention and includes at least one molecular pump stage, in particular a Holweck stage, which includes a rotor member which forms the pump-active surface of the molecular pump stage. The vacuum pump furthermore includes at least one side channel pump stage which is arranged downstream of the molecular pump stage and which includes a plurality of rotor elements. The rotor elements of the side channel pump stage are supported by the rotor member of the molecular pump stage.

It has been recognized in accordance with the invention that a minimal space requirement is achieved with an ideal performance of the side channel pump stage when the rotor member of the molecular pump stage is simultaneously used as a support for the rotor elements of the side channel pump stage. The rotor elements consequently do not have to be arranged at a radial spacing from the rotor member of the molecular pump stage so that the construction space present inside the rotor member of the molecular pump stage is available for other components of the vacuum pump, for example for a drive of the vacuum pump. The rotor elements are furthermore located at a relatively large radial spacing from the axis of rotation of the vacuum pumps which can approximately correspond to the radius of the rotor member so that a side channel pump stage having a large radius of rotation and a correspondingly high pump performance is provided. A powerful and energy-saving operation of the pump is thus also ensured at high exit pressures and/or roughing pressures and high inlet pressures.

The accessibility of the rotor elements is improved due to their arrangement at the rotor member, whereby the complexity of the pump design is reduced and e.g. also the installation of a cooling apparatus for the side channel pump stage is facilitated.

Advantageous embodiments of the vacuum pump are also described in the description, in the dependent claims and in the Figures.

The vacuum pump can include a support of the rotor member as described in the following or a support part of the rotor member at which the rotor elements are arranged and by which the rotor elements are supported. The support or the support part can also be considered as part of the side channel pump stage instead of the rotor member. The support or the support part is, in accordance with an embodiment, not arranged at an axial end of a Holweck rotor to which the support or the support part is connected. The Holweck rotor can include the rotor member and can additionally include a hub of the vacuum pump supporting the rotor member. The support or the support part can be arranged at a region of the Holweck rotor spaced apart from an or each axial end of the Holweck rotor instead of at an axial end of the Holweck rotor.

The rotor elements are preferably arranged outside a region surrounded by the rotor member formed, for example, as a Holweck sleeve. A particularly good accessibility and a particularly low complexity of the pump structure can thereby be achieved with a simultaneously large radius of rotation of the side channel pump stage. The rotor elements can be arranged fully or partly outside the region which is entirely surrounded by the pump-active surface of the rotor motor or by the rotor member.

The rotor member can be supported by a rotor hub. In this embodiment, the rotor elements of the side channel pump stage are therefore supported by the rotor member which is in turn supported by the rotor hub. The rotor hub is preferably flat and in particular of disk shape and preferably extends substantially in a radial plane with respect to the axis of rotation of the rotor. The rotor member preferably projects from the rotor hub in an axial direction. The rotor hub is in turn preferably connected to a rotor shaft. The rotor hub and the rotor member can in principle be formed as different parts connected to one another or can be connected to one another in one part.

The rotor elements are preferably arranged an end, in particular a free end, of the rotor member. The in particular free end of the rotor member can be formed, for example, by an axial end, and preferably by an end of the rotor member remote from the rotor hub, for example by an axial end of the rotor member remote from the rotor hub. The rotor elements, which are preferably designed as rotor vanes, can project from the rotor member in the axial direction or in a direction which has at least one direction component in parallel to the axis of rotation of the vacuum pump and is preferably in parallel to the axis of rotation of the vacuum pump. The rotor elements can also have an orientation inclined radially inwardly or radially outwardly by up to 45°, for example, with respect to the axis of rotation of the vacuum pump and can project from the rotor member in this direction. The stator of the side channel pump stage can be arranged in the region of the free end of the rotor member or in an oppositely disposed static region of the vacuum pump. A particular favorable structure results from this since in particular no nesting of the rotor member with the stator of the side channel pump stage is required so that a particularly simply assemblable and compact construction shape of the vacuum pump is achieved.

The rotor elements can extend in the axial direction beyond the pump-active surface of the rotor member and preferably beyond the rotor member as a whole. This permits a particularly favorable arrangement of the stator and of the stator channels of the side channel pump stage in a construction respect in a static region of the pump disposed opposite the rotor elements in the axial direction, without a complex nesting of rotor elements and stator elements of the different pump stages being necessary. The accessibility of the side channel pump stage is furthermore increased. The stator channel or side channel in which the rotor elements revolve can have an open design e.g. in the axial direction, e.g. to allow the reception of rotor elements projecting in the axial direction.

The rotor elements which are formed as rotor vanes, for example, are preferably arranged directly at the rotor member and are supported by it. The rotor member can include a support which is preferably arranged at an in particular free axial end of the rotor member and at which the rotor elements are arranged. The support is preferably of ring-shaped design and preferably includes a support surface which extends in ring shape about the axis of rotation of the vacuum pump and at which the rotor elements are arranged. The support surface can, for example, be formed as planar and can face in the axial direction of the vacuum pump or it can have a substantially frustoconical jacket shape and have a surface normal which is radially inwardly or radially outwardly inclined with respect to the axis of rotation of the vacuum pump, e.g. by up to 45°.

The free end of the rotor member can be formed wholly or partly by the support of the rotor member. The support surface of the support can be formed, for example, by an axial end face of the rotor member. The design is suitable, for example, for an embodiment as described above in which the rotor elements project in the axial direction and stator channels which are oppositely disposed in the axial direction e.g. are associated with the rotor elements.

The support for the rotor elements can form a step or overhang of the rotor member projecting in the radial direction. In particular when a radial outer surface of the rotor member forms the pump-active surface of the rotor member such as can, for example, be the case with a Holweck sleeve as the rotor member, the support can form a step or an overhang projecting inwardly in the radial direction. In principle, the support can, however, also project outwardly in the radial direction and form such a step or overhang. The rotor member can be designed substantially in L shape viewed in the longitudinal direction, with the short limb of the L shape being able to be formed by the step or overhang of the rotor member. A shape of the support suitable for the support of the rotor element can be provided by such a step or overhang without the rotor member having to be made thickened over its total length so that the space requirement of the rotor member is kept small. In principle, the support can also be formed by a region of the rotor member which is aligned with an adjacent region of the rotor member in the axial direction, that is without any real radial step or overhang. In this case, the rotor elements can be arranged directly at the axial end face of a rotor member, with the rotor member having an at least approximately unchanging inner cross-section and/or outer cross-section over its total longitudinal extent.

The rotor member is preferably substantially designed as a sleeve and in particular forms a Holweck sleeve or a Holweck cylinder. The rotor member can in this respect extend in sleeve shape about the axis of rotation of the vacuum pump and can be formed substantially rotationally symmetrical to the axis of rotation, with a longitudinal axis of the sleeve preferably substantially coinciding with the axis of rotation of the vacuum pump. The sleeve-like rotor member can be arranged at one of its axial ends at a rotor hub as described above or can be supported by it or fastened to it, whereas the rotor elements of the side channel pump stage are arranged at the other axial end.

In accordance with an advantageous embodiment, the rotor member includes a base which is in particular substantially formed as a sleeve and which preferably has a form closed in ring shape about the axis of rotation and preferably substantially rotationally symmetrical. The base preferably extends from a rotor hub supporting the rotor member up to a support of the rotor member such as described above and at which the rotor elements are arranged. The pump-active surface of the molecular pump stage is preferably formed at least partly or substantially completely by the base.

The support of the rotor member can be formed substantially as a sleeve which preferably has a form closed in ring shape about the axis of rotation and preferably has a substantially rotationally symmetrical form.

At least one of the components of base and support is preferably connected directly in one part or in multiple parts to the rotor hub and is supported by it. The respective other component can be supported by the component directly connected to the rotor hub, in particular without itself being connected directly to the rotor hub and being supported by it. In principle, both components, i.e. both the base and the support, can also be connected directly in one part or in multiple parts to the rotor hub and can be supported by it. The base and the support are preferably mutually connected in one part or in multiple parts, preferably independently of the rotor hub. For example, the base and the support can contact one another in an overlapping manner in the radial direction and can be connected to one another in the overlap region. The base and the support can equally be spaced apart from one another in the radial direction and can be connected to one another or held at one another independently of the rotor hub.

The rotor member can in principle have a multipart design, with e.g. a base such as is described above which is supported by a rotor hub and a support such as is described above at which the rotor elements are arranged each forming a respective part of the rotor member, i.e. the rotor member can in particular include a base part or component forming the base and a support part or component forming the support which are preferably connected to one another, with the support part being able to be carried by the base part. Corresponding to the preferably sleeve-shaped design of the base and of the support, the base part can be formed by a base sleeve and the support part can be formed by a support sleeve. In principle, the rotor member can, however, also be made as a single part or at least include a base and a support which are formed in one part with one another.

The connection between the base part and the support part can, for example, include a clamp connection which can in particular be established by a shrinking procedure. A screw connection and/or a bond connection can equally be provided between the base part and the support part. The base part and the support part can mutually overlap in the region of their connection in the radial direction. The support part can, for example, have a sleeve-like connection section whose outer diameter at least approximately corresponds to the inner diameter of the preferably sleeve-like base part, with the outer surface of the connection section of the support part and the inner surface of the base part contacting one another areally. The rotor elements can in this respect be arranged at a support section of the support part adjoining the connection section of the support part, preferably in the axial direction, with the support section being able to protrude radially inwardly or outwardly with respect to the connection section.

One or more rotor elements can be formed as separate parts and can be connected in multiple parts to a support and in particular to a support part as described above.

The base part and the support part of the rotor member can in principle be formed from different or identical materials. The base part can, for example, comprise or consist of a material containing carbon or a metallic material, for example a carbon fiber reinforced composite (CRP) material. The support part can likewise comprise or consist of a material containing carbon, for example a carbon fiber reinforced composite (CRP) material and/or a metallic material such as aluminum. For example, the support part can be a ring-shaped component which is made as metallic and is provided with a reinforcement of fiber-reinforced material. The support part can, for example, be a CRP-reinforced metal sleeve.

In principle, the rotor member can also be formed in one part and can comprise or consist of a carbon fiber reinforced composite (CRP) material or a metallic material. The rotor member or a base part of the rotor member and a rotor hub supporting the rotor member can likewise be designed as parts connected to one another or in one part to one another. It is preferred if the base part of the rotor member is formed as an independent part and preferably as a sleeve in the shape of a cylinder jacket which comprises CRP material, for example.

The rotor member, the base and/or the support or the base part and/or the support part are each preferably formed, as described above, substantially in sleeve shape or as a sleeve. The respective component is in this respect preferably formed substantially in the shape of a cylinder jacket at least in a longitudinal section, with the longitudinal axis of the cylinder jacket preferably substantially coinciding with the axis of rotation of the pump.

The rotor member preferably has at least one longitudinal section in which the rotor member is bounded by a radially inner surface substantially in the shape of a cylinder jacket and/or by a radial outer surface substantially in the shape of a cylinder jacket, with the cylinder respectively defined by the inner surface or outer surface preferably being made substantially straight and being oriented at least approximately in parallel to the axis of rotation of the pump.

The rotor member can, for example, have a longitudinal section such as described above having a radially outer surface which is at least approximately the shape of a cylinder jacket and which extends e.g. over at least 50% or 75% and preferably at least approximately over the total axial length of the rotor member.

The radial outer surface of the rotor member in the shape of a cylinder jacket can, for example, be formed by the radial outer surface of a base or of a base part of the rotor member, with the base part being formed e.g. as a rotating Holweck sleeve and having the shape over a part of its axial length, and preferably at least approximately over its total axial length, of a straight cylinder jacket oriented in the axial direction and preferably having a constant wall thickness. The radial outer surface of the rotor member can in this respect form at least a part of the pump-active surface of the molecular pump stage. The pump-active surface is in this respect preferably formed as a smooth surface and can e.g. be disposed opposite the radial inner side of a stator sleeve at which a Holweck thread can be arranged. In principle, however, the pump-active surface of the Holweck sleeve can also have a Holweck thread, with then the oppositely disposed surface of the stator sleeve preferably being made smooth. The rotor member can have a unchanging, preferably rotationally symmetrical outer cross-section over substantially its whole length.

The radial inner surface of the rotor member can also have the shape of a straight cylinder jacket oriented in the direction of rotation of the axis in at least a longitudinal section of the rotor member, with the radial inner surface and the radial outer surface of the rotor member preferably forming a cylinder jacket with a substantially constant wall thickness in this longitudinal section. The radial inner surface can in this respect be formed in this longitudinal section by the radial inner surface of a base or of a base part of the rotor member as described above. This longitudinal section can, for example, cover at least 40% or 75% and in particular at least approximately the total axial length of the rotor member.

The radial extent of the rotor member can be kept as small as possible by the above-described embodiment so that a compact construction shape of the vacuum pump is achieved. The preferably cylindrical free space defined by the radial inner surface in the interior of the rotor member is, for example, suitable for accommodating a drive of the vacuum pump.

The rotor member can also have a first and a second longitudinal section in which the radial inner surface of the rotor member respectively has the shape of a straight cylinder jacket oriented in the direction of the axis of rotation and which together preferably cover at least 40% or 75% and in particular at least approximately the whole axial length of the rotor member. The radial inner surface can, for example, be formed by a base or by a base part of the rotor member in the first longitudinal section of the rotor member, whereas it is formed by the radial inner surface of a support or of a support part of the rotor member in the second longitudinal section.

The diameter of the cylinder jacket respectively defined by the radial inner surface can in this respect be different for the first and second longitudinal sections. Accordingly, the wall thickness of a cylinder jacket respectively defined by the radial inner surface and the radial outer surface of the rotor member can also be different in the first and second longitudinal sections. The support or the support part can in this respect define a smaller inner diameter of the rotor member in the second longitudinal section than the base or the base part of the rotor member in the first longitudinal section. The transition between the first and second longitudinal sections of the rotor member can in this respect include a radial projection or overhang of the rotor member as described above formed by the support or the support part.

In the second longitudinal section in which the radial inner surface of the rotor member is preferably formed by the support or the support part, the support or the support part is preferably arranged within the base or the base part so that the support or the support part and the base or the base part overlap in the radial direction. The support part can, for example, be formed by a support sleeve having a sleeve-like connection section such as described above and which is inserted into the base part and is preferably connected to the base part at an axial end of the base part.

As described above, the molecular pump stage is preferably formed as a Holweck stage, with the rotor member forming a Holweck sleeve and with a corresponding stator sleeve preferably being associated with the Holweck sleeve. The Holweck stage includes a Holweck thread having at least one, and preferably a plurality of spiral or helical grooves extending in the direction of the axis of rotation and open in the radial direction and includes a substantially smooth surface arranged opposite the Holweck thread, moving with respect to the Holweck thread and defining a narrow gap with the Holweck thread. The grooves each form a flow channel of the Holweck stage. The Holweck thread can in principle be arranged either at the rotor member of the Holweck stage or at a stator or at a stator sleeve of the Holweck stage. It is preferred if the Holweck thread is arranged at the stator sleeve and if the rotor member forms a substantially smooth pump-active surface rotating with respect to the stator sleeve, in particular in the form of a radial outer surface of the rotor member in the shape of a cylinder jacket.

In accordance with an advantageous embodiment, the molecular pump stage includes an upstream first section and a downstream second section leading to the side channel pump stage, with a smaller number of flow channels being formed in the second section than in the first section. The flow channels of the second section can in this respect form one or more supply channels which lead into the side channel pump stage. The first and second sections preferably follow one another in the axial direction. The number of supply channels can correspond, for example, to the number of gas inlets of the side channel pump stage. The supply channels serve for the bundling of the gas conveyed through the first section of the molecular pump stage, with a collection channel being able to be formed between the first and second sections, which preferably revolves about the axis of rotation in the peripheral direction and which connects the flow channels of the first section to one another. The flow channels of the first and/or second sections are preferably part of a Holweck thread of a Holweck stage and are preferably arranged at the static part of the molecular pump stage such as at a stator sleeve of the Holweck stage.

The vacuum pump can include a plurality of Holweck stages which are connected behind one another in the flow direction and which are flowed through by the gas, preferably one after the other. The Holweck stages can in this respect be arranged within one another in the radial direction and can be nested with one another, whereby an ideal utilization of space is ensured. The gas can flow over the plurality of Holweck stages from radially inwardly to radially outwardly or from radially outwardly to radially inwardly. The rotor member at which the rotor elements of the side channel pump stage are supported in this respect preferably form a Holweck stage which is arranged downstream of one or more further Holweck stages. A further rotor member can be associated with the further Holweck stages and is preferably formed as a Holweck stage substantially in the shape of a cylinder jacket. In this respect, both the radial outer surface and the radial inner surface of the further rotor member can form a pump-active surface of a respective Holweck stage. In the rotor member supporting the rotor elements, in contrast in particular only the radially outer surface can form a pump-active surface of the Holweck stage.

The rotor elements of the side channel pump stage can be formed in a manner known per se as vanes or rotor vanes which are preferably arranged in a plant extending perpendicular to the axis of rotation along a circular ring revolving about the axis of rotation, with the vane surfaces of the rotor elements preferably facing at least partly in the revolving direction. The vane surfaces can in this respect have a shape slightly inclined against the revolving direction toward the rear in the axial direction and/or in the radial direction. The vanes can be part of a wheel of vanes in accordance with the side channel principle which includes the side channel pump stage. The side channel pump stage preferably further includes at least one stator channel or side channel in which the rotor elements revolve and which is preferably arranged in ring shape about the axis of rotation in accordance with the ring-shaped arrangement of the rotor elements. The side channel preferably has a cross-section enlarged with respect to the rotor elements over at least a part of its length in a manner known per se. The side channel preferably has the enlarged cross-section over approximately its whole length, with a scraping region with a scraper preferably being provided at an end associated with the outlet of the side channel in which the channel is narrowed to a cross-section which substantially corresponds to the outline of the rotor elements so that the rotor elements can just pass through the narrowed region and the scraper scrapes off the gas conveyed through the side channel and introduces the gas flow into the gas outlet of the side channel pump stage. A gas inlet of the side channel pump stage can be arranged at the other end of the scraper and is preferably connected to a supply passage of the molecular pump stage as described above. The side channel can also comprise a plurality of part channels each having an inlet, an outlet and a scraping region therebetween, with preferably a supply channel of the molecular pump being associated with each part channel and being connected to its inlet.

In accordance with an embodiment, beside the above-described side channel pump stage, a further second side channel pump stage is provided whose design can correspond to the above-described side channel pump stage. The second side channel pump stage is preferably arranged directly downstream of the above-described side channel pump stage, with the two side channel pump stages preferably being arranged nested in one another in the radial direction. The rotor elements of the second side channel pump stage are in this respect preferably likewise supported by the rotor member of the molecular pump stage and in particular by a support of the rotor member supporting the rotor elements of the above-described side channel pump stage. The rotor elements of the second side channel pump stage can in this respect be arranged with the rotor elements of the above-described side channel pump stage substantially in a common plane extending perpendicular to the axis of rotation. The rotor elements of the second side channel pump stage can be arranged along a circular ring revolving about the axis of rotation, said ring being concentric to the axis of rotation and to the circular ring formed by the above-described side channel pump stage and having a smaller or larger radius than this ring. The outlet of the one side channel pump stage is in this respect connected by a flow channel to an inlet of the other side channel pump stage.

In accordance with an advantageous embodiment, a balancing plane is provided which is arranged in the region of a support of the rotor member supporting the rotor elements. The balancing plane can have a plurality of devices arranged distributed over the periphery of the support for attaching balancing masses. Such a device can, for example, include an opening such as a balancing bore, for example a threaded bore and/or a blind bore with a preferably metric thread, which can be formed, for example of the type M2 or M3. The openings or balancing bores are preferably arranged in a support surface of the support at which the rotor elements are arranged, and indeed preferably in the regions of the support surface arranged between the rotor elements. A respective balancing weight can be screwed into one or more balancing bores and is preferably arranged at least approximately completely countersunk in the balancing bore and terminates flush e.g. with the support surface of the support. Any imbalance which may be caused by the support for the rotor elements can be eliminated by such a balancing plane and the running properties of the pump can be improved.

A second subject of the invention is formed by a vacuum pump having a Holweck pump section which includes a Holweck rotor and having a roughing pressure stage which follows in the gas flow and which includes a rotor component, with the rotor component being connected to the Holweck rotor and being arranged at an axial end of the Holweck rotor.

The embodiment is advantageous according to which the Holweck rotor is connected to a shaft at a second axial end. This enhances the cost advantage and reduces the construction volume of the vacuum pump since the drive motor can be arranged within the inner space of the Holweck pump section and/or of the roughing pressure stage.

In accordance with an embodiment, the roughing pressure stage has a ring-shaped component or rotor component which includes a pump structure and is connected to a sleeve of the Holweck rotor.

A particularly simple embodiment provides a ring-shaped component of the roughing pressure stage which is provided at the axial end of a sleeve of the Holweck rotor. The exit pressure of the pump in the region above 10 Hectopascal is improved by the roughing pressure stage. The embodiment of the roughing pressure stage in accordance with the side channel principle is particularly effective and inexpensive. The roughing pressure stage can include a ring of vanes in accordance with the side channel principle. The roughing pressure stage can have a multistage design.

The roughing pressure stage can include a ring-shaped component which is designed in one piece with a hub of the Holweck rotor.

The ring-shaped component can be of a metallic design and be reinforced by a reinforcement of fiber-reinforced material.

The Holweck pump section can include a plurality of pump stages.

A dynamic seal can be arranged between the Holweck pump and the roughing pressure stage. The Holweck pump section can include a passage at the stator side through which gas enters into the roughing pressure stage and a part of the stator associated with the channel can form a sealing stator of the dynamic seal.

An additional advantage can be achieved if a component of the roughing pressure stage is provided with a balancing means, for example a balancing bore. The smooth running increases to that clearances can be reduced. In turn, this increases the performance capability of the pump stages so that the cost-related performance capability increases.

An additional intermediate inlet through which gas can be sucked into the roughing pressure stage allows the simplification of pump systems having a plurality of vacuum pumps, for example. A further molecular pump can be connected to this intermediate inlet and a second chamber is, for example, evacuated by it. The roughing pressure stage then acts as a pump stage for the vacuum pump and the molecular pump.

The invention also comprises all the technically realizable embodiments of a pump which result starting from a pump such as described herein in accordance with the first subject of the invention by additional implementation of any desired features or feature combinations of a pump in accordance with the second subject of the invention and vice versa.

A third subject of the invention is a vacuum pump having the features of claim 10.

The vacuum pump includes a molecular pump stage, in particular a Holweck stage, and at least one side channel pump stage which is arranged downstream of the molecular pump stage and which includes a plurality of rotor elements, with the side channel pump stage being arranged between a pump inlet and the molecular pump stage.

The order in which the side channel pump stage and the molecular pump stage follow one another in the axial direction starting from the pump inlet is consequently swapped over with respect to the order in which the pump stages are flowed through by the gas since the side channel pump stage is arranged downstream in the gas flow direction and at the inlet side of the molecular pump stage in a geometrical respect. Within the framework of the inlet-side arrangement of the side channel pump stage, its rotor elements can be arranged outside a rotor member of the molecular pump stage, for example of a Holweck sleeve or of a Holweck cylinder, and the diameter of the side channel pump stage can accordingly be selected to be relatively large and in particular at least approximately equally as large or even larger than the diameter of the rotor member of the molecular pump stage. A particularly powerful vacuum pump is provided in this manner.

In addition, no additional space requirements at the side of the molecular pump stage remote from the inlet is provided due to the arrangement of the side channel pump stage at the inlet side. This has the advantage that the accessibility of the molecular pump stage in this region remote from the inlet is not restricted by the side channel pump stage so that it is easily possible, for example, to install the stator elements of the molecular pump stage, in particular one or more stator sleeves of a Holweck stage, at a rear wall of the housing of the vacuum pump remote from the inlet. A particularly simple construction form is thereby achieved which results in a particularly small axial length of the vacuum pump. An excessive additional axial space requirement for the side channel pump stage is in this respect just as equally avoided as a complicated nesting of rotor elements and/or stator elements of the molecular pump stage and of the side channel pump stage. In addition, further components of the pump such as a drive can be arranged in the freely accessible interior of the molecular pump stage without increasing the complexity of the pump structure.

In accordance with an embodiment, a gas flow path from the pump inlet leads past the pump-active structure of the side channel pump stage into the molecular pump stage. Such a bypass path can, for example, lead radially inwardly and/or radially outwardly past the pump-active structure into the molecular pump stage. The pump-active structure of the side channel pump stage which the gas is led past can in principle have a design such as was described above with respect to the vacuum pump in accordance with claim 1 and can in particular have rotor elements formed as rotor vanes and at least one side channel at the stator side.

In accordance with an advantageous embodiment, the gas flow path provided for bypassing the side channel pump stage leads through one or more openings of a rotor hub, in particular of disk shape, supporting the rotor elements of the side channel pump stage. The openings can in this respect be formed by apertures extending though the rotor hub in the axial direction. The rotor hub of the side channel pump stage in this embodiment forms a gas inlet into the molecular pump stage.

A gas flow path such as described above and extending through the rotor hub of the side channel pump stage can expediently be radially inwardly led past the pump-active structure of the side-channel pump stage. It is equally possible that a gas flow path leads radially outwardly past the side channel pump stage into the molecular pump stage. Such a gas flow path can include, for example, a channel arranged in the stator or in the housing of the vacuum pump and leading past the pump-active structure.

The molecular pump stage preferably effects a reversal of the gas flow direction so that the gas flow can enter into the side channel pump stage arranged at the inlet side of the molecular pump without any complex bypassing after running through the molecular pump stage. Such a reversal of direction can be effected in a simple manner in that the molecular pump stage includes a plurality of Holweck stages, with an identical number of Holweck stages being provided pumping in the axial direction away from the gas inlet and in the axial direction toward the gas inlet.

In accordance with an embodiment, a gas flow path leading from the molecular pump stage into the side channel pump stage extends through one or more openings of a rotor hub, in particular of disk shape, supporting a rotor member of the molecular pump stage. The gas can thereby move through the rotor hub into the side channel pump stage arranged at the inlet side after any reversal of direction effected by the molecular pump stage so that the rotor hub supporting the rotor member forms a gas inlet for the side channel pump stage. In principle, the gas flow can, however, also enter into the side channel pump stage at the inlet side laterally past the rotor hub. In an embodiment which will be explained in the following, the rotor elements of the side channel pump stage are located with the rotor member of the molecular pump stage at the same hub, in which case the gas flow from the molecular pump stage can enter from the molecular pump stage into the side channel pump stage from the molecular pump stage directly and without a complete crossing or bypassing of the rotor hub.

As described above with reference to specific examples, in the vacuum pump in accordance with the invention, a rotor hub supporting the rotor elements of the side channel pump stage and/or supporting a rotor element of the molecular pump stage can be formed as a gas inlet which leads either into the molecular pump stage or from the molecular pump stage into the side channel pump stage. The respective rotor hub can for this purpose preferably have one or more apertures which extend through the rotor hub in the axial direction and form flow channels for the gas. The respective rotor hub can in principle be formed by a rotor hub as described above with respect to the vacuum pump in accordance with claim 1, said rotor hub preferably being of disk shape and being oriented in the radial direction.

In accordance with an advantageous embodiment, the rotor elements of the side channel pump stage are arranged in the region of a radial outer side of a, preferably disk-shaped, rotor hub. The rotor elements can in this respect project from a margin of the rotor hub. The rotor elements preferably project in the radial direction from the margin or in a direction which has at least one radial component and is preferably at least approximately parallel to the radial direction. A particularly large radial spacing of the rotor elements from the axis of rotation and thus a large radius of rotation and a correspondingly high performance of the side channel pump stage can thereby be achieved. In addition, in this embodiment, the side channels at the stator side can be formed as channels open in the radial direction and/or can be arranged in the region of a radial outer wall of the vacuum pump, whereby an extremely compact construction shape of the vacuum pump is made possible which in particular manages without complex nestings of rotor elements and stator elements.

In accordance with an advantageous embodiment, the rotor member of the molecular pump stage and the rotor elements of the side channel pump stage are supported by a common, preferably disk-shaped, rotor hub. The rotor elements can in this respect project from a margin of the rotor hub, whereas one or more rotor members of the molecular pump stage preferably extend in the axial direction starting from a flat side of the rotor hub. A particularly compact construction shape is thereby achieved since separate rotor hubs for the side channel pump stage and the molecular pump stage can be dispensed with. In addition, the gas can enter directly from the molecular pump stage into the side channel pump stage without crossing the rotor hub or completely bypassing it in so doing, whereby the complexity of the pump structure is reduced and the pump efficiency is increased since a high leak-tightness of the gas flow path is achieved overall.

The molecular pump stage is preferably a Holweck stage which can in principle be designed as described above with respect to the vacuum pump in accordance with claim 1. The Holweck stage preferably includes at least one rotor member, which forms a pump-active surface of the Holweck stage and is preferably designed as a Holweck sleeve, and a stator sleeve corresponding with the rotor members. The vacuum pump can also have a plurality of molecular pump stages or Holweck stages such as described above with respect to the vacuum pump in accordance with claim 1 and which are connected behind one another in the gas flow direction, which are preferably arranged in one another in the radial direction and nested with one another and via which a gas flow path leads e.g. from radially inwardly to radially outwardly or from radially outwardly to radially inwardly.

If the gas flow path leads via the molecular pump stages from radially inwardly to radially outwardly, a gas inlet for the molecular pump stages preferably includes one or more apertures of a rotor hub at which one or more rotor members of the molecular pump stages are arranged. In this manner, the gas can be supplied to the molecular pump stages at a radially inwardly disposed position. If the gas flow path leads via the molecular pump stages from radially outwardly to radially inwardly, the gas of the molecular pump stage can in contrast be supplied via a gas flow path bypassing the side channel pump stage radially outwardly. The gas inlet into the side channel pump stage can then include one or more apertures of a rotor hub supporting one or more rotor members of the molecular pump stage to supply the gas from the radially inwardly disposed end of the molecular pump stage of the side channel pump stage.

In accordance with an advantageous embodiment, at least one further pump stage is provided which is arranged upstream of the molecular pump stage. It can in this respect in particular be a turbomolecular pump stage. The side channel pump stage is in this respect preferably arranged between the further pump stage and the molecular pump stage. The further pump stage, the side channel pump stage and the molecular pump stage can accordingly be arranged behind one another and follow one another in this order starting from the pump inlet along the axial direction of the vacuum pump. The gas flow path of the vacuum pump preferably leads from the pump inlet into the further pump stage, e.g. turbomolecular pump stage, and from there past the side channel pump stage into the molecular pump stage and from there into the side channel pump stage.

The molecular pump stage and the further pump stage can be arranged at different sides of a rotor hub supporting a rotor member of the molecular pump stage.

A further pump stage, in particular a turbomolecular pump stage, as described above, can also be provided in a vacuum pump as described above with respect to claim 1. A turbomolecular pump stage can generally have one or more rotor disks and stator disks in a manner known per se which extend in a radial plane, are arranged behind one another in the axial direction, are nested with one another and have gas channels extending obliquely to the axial direction. An upstream end of the further pump stage can in this respect be arranged directly in the region of a pump inlet whose diameter can, for example, at least approximately correspond to the diameter of a rotor disk of the turbomolecular pump stage.

The pump inlet is in principle preferably surrounded by a flange which can extend in ring shape around the axis of rotation of the vacuum pump. A vacuum pump in accordance with the invention furthermore preferably has a pump outlet which can be surrounded, for example, by a small flange. The pump outlet is preferably connected to a gas outlet of the side channel pump stage and is arranged, viewed in the direction of the axis of rotation, preferably at least approximately at the level of the side channel pump stage.

In addition to the pump inlet arranged upstream of the pump stage and the pump outlet arranged downstream of the pump stages, a pump in accordance with the invention can include one or more taps or intermediate inlets which can be arranged at a point along the gas flow path between the pump inlet and the pump outlet and leading from a pump inlet to a pump outlet and can form an opening into the gas flow path at the respective point. For example, a tap or an intermediate inlet can be provided, for example, arranged downstream of the turbomolecular pump stage and upstream of the molecular pump stag or a tap or an intermediate inlet arranged downstream of the molecular pump stage and upstream of the side channel pump and through which gas can be sucked into the side channel pump stage.

Figure 2:
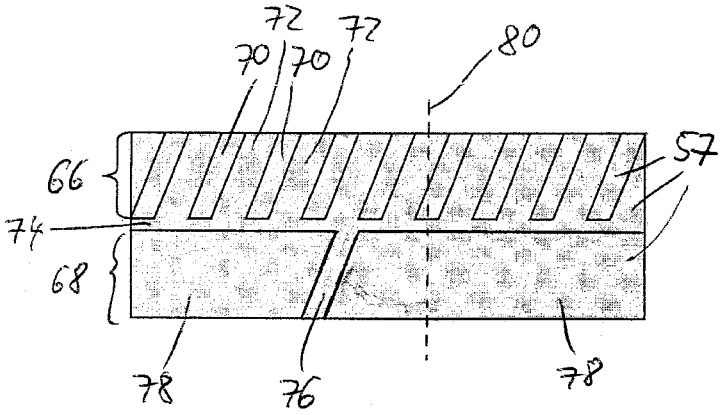
Figure 3:
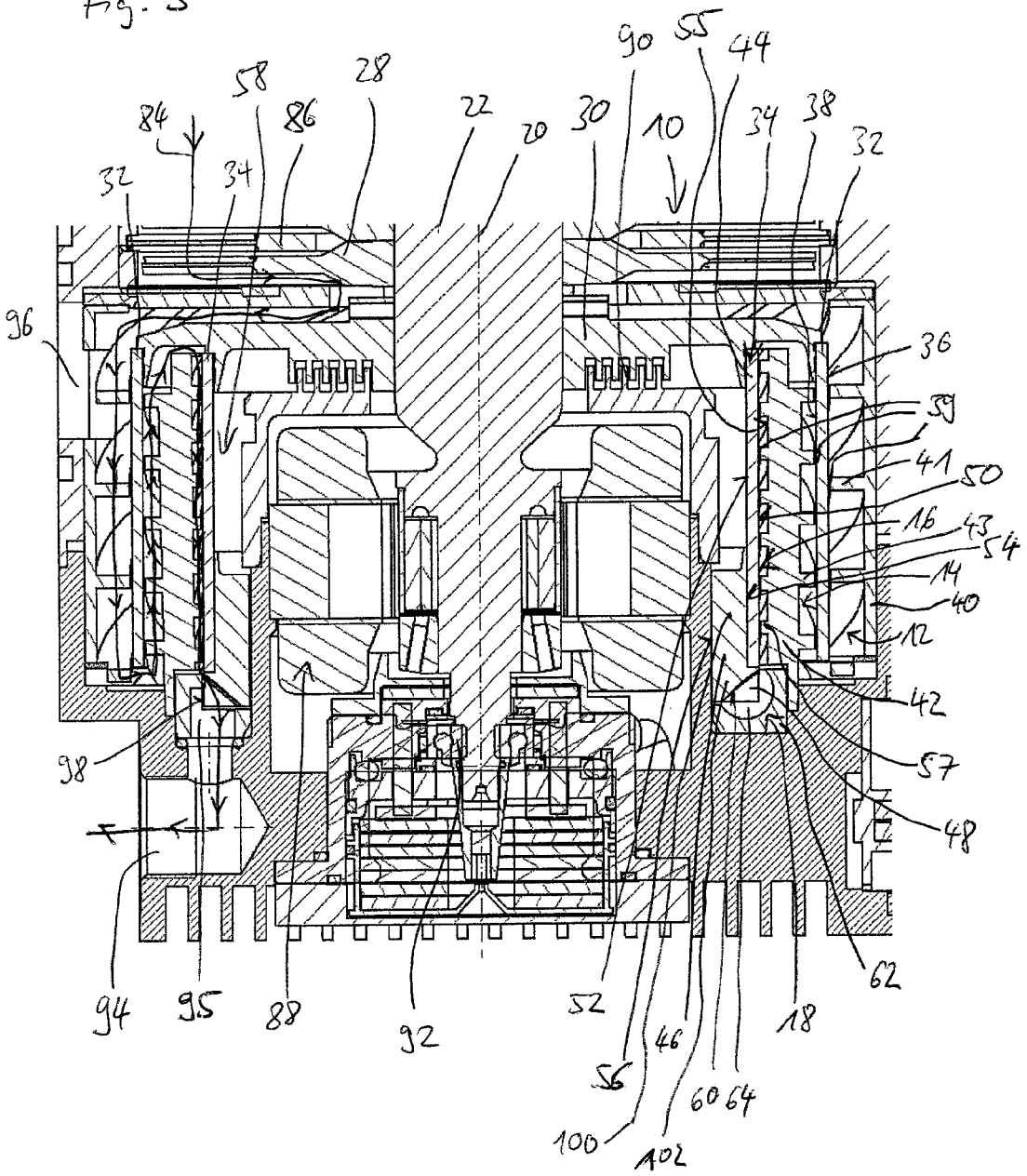
Figure 4:
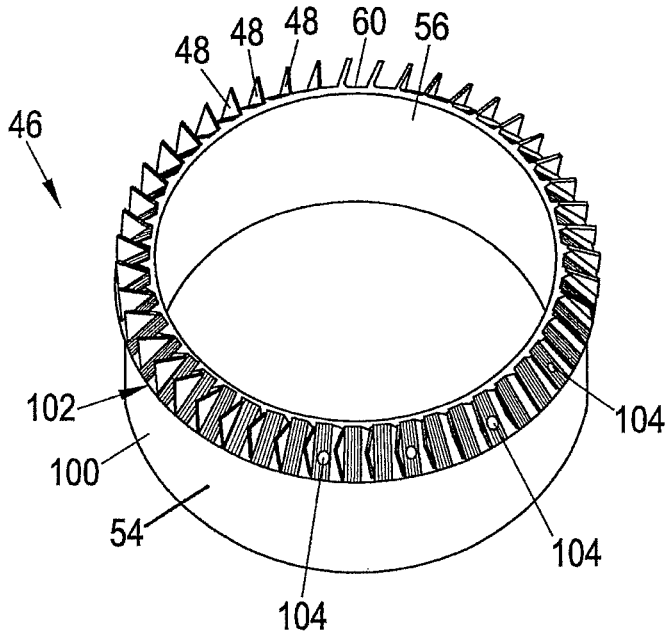
Figure 5:
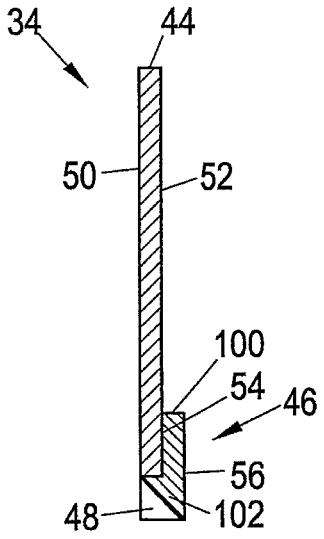
Figure 6:
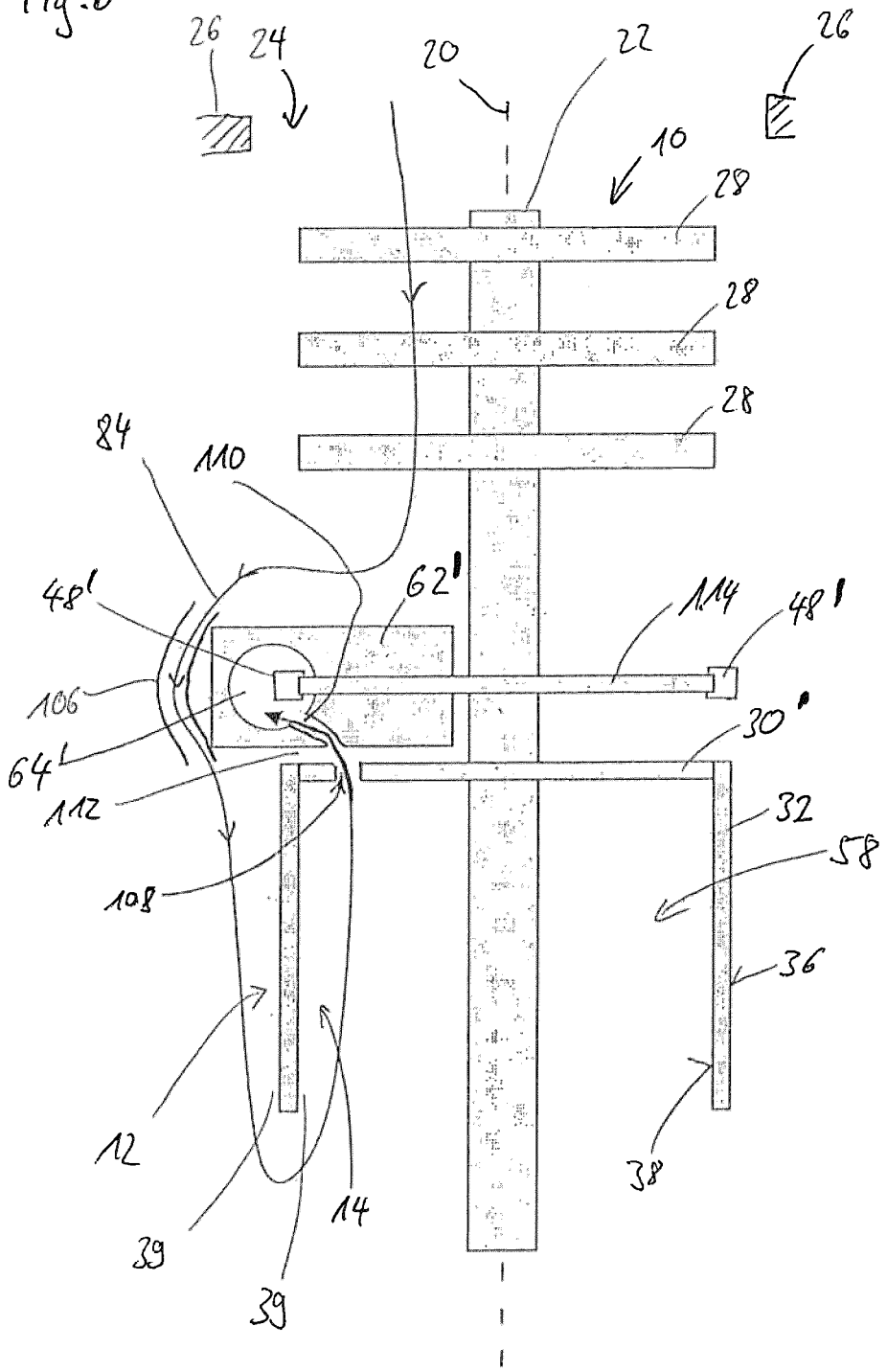
Figure 7:
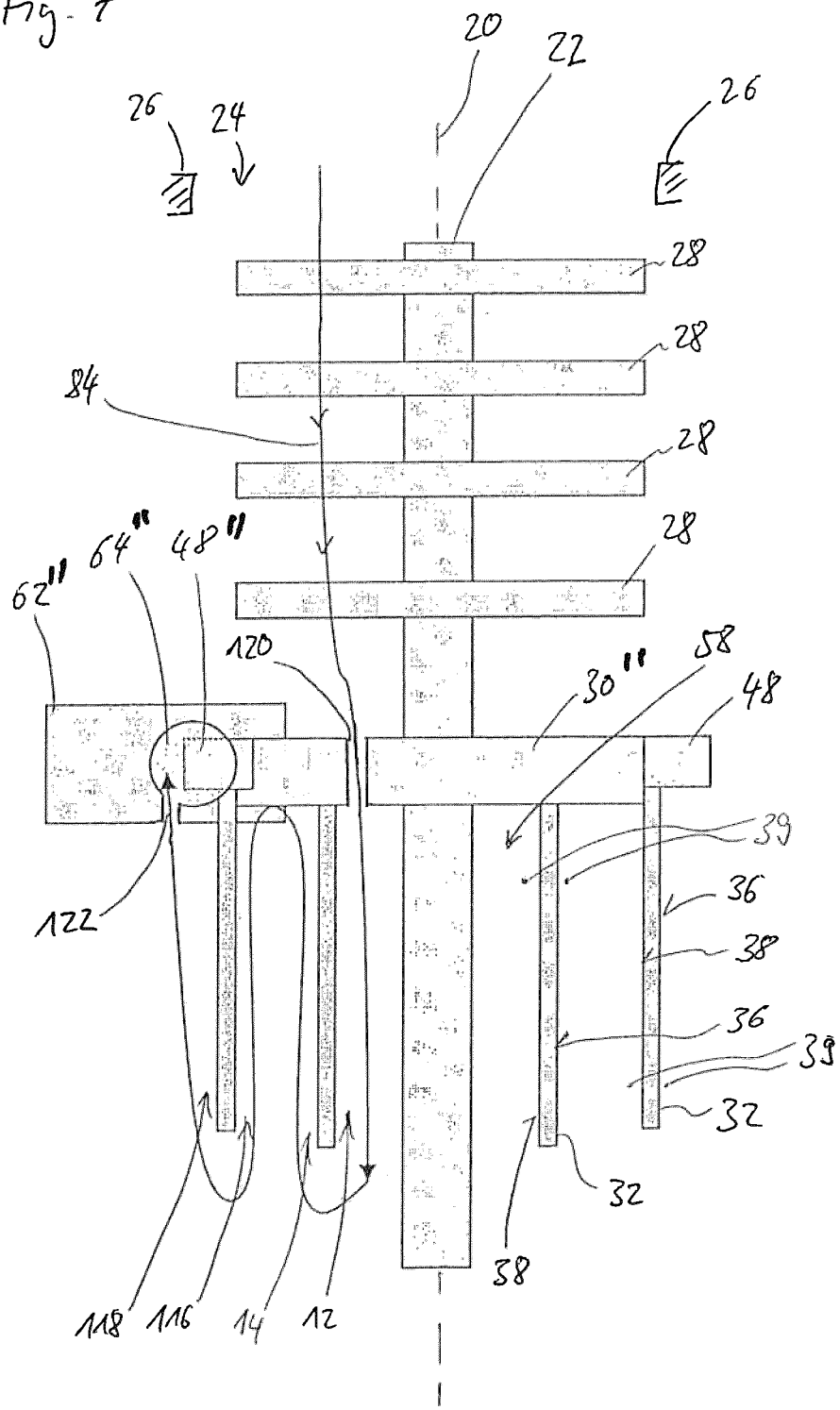

The invention will be described in the following by way of example with reference to advantageous embodiments and to the enclosed Figures. There are shown:

FIG. 1 a schematic representation of a vacuum pump in accordance with an embodiment of the invention in an axial section;

FIG. 2 a flattened representation of an inner stator sleeve of the vacuum pump shown in FIG. 1;

FIG. 3 a vacuum pump in accordance with a further embodiment of the invention in an axial section;

FIG. 4 the support sleeve with the rotor elements of the vacuum pump shown in FIG. 3 in a perspective representation;

FIG. 5 the rotor member of the vacuum pump shown in FIG. 3 including the support sleeve and the rotor elements shown in FIG. 4 in an axial section;

FIG. 6 a vacuum pump in accordance with a further embodiment of the invention in an axial section; and FIG. 7 a vacuum pump in accordance with a further embodiment of the invention in an axial section.

FIG. 1 shows a schematic representation of a vacuum pump in accordance with an embodiment of the invention in an axial section. Parts of the vacuum pump are not shown in FIG. 1 for better clarity.

The vacuum pump includes a turbomolecular pump stage 10, a plurality of molecular pump stages 12, 14, 16 and a side channel pump stage 18 which follow one another in the gas flow or in the flow direction of the gas.

The vacuum pump includes a rotor shaft 22 which is rotatingly drivable about an axis of rotation 20 and at which rotating elements of the pump stages 10 to 16 explained individually in the following are arranged. The rotating elements and the associated stator elements of the pump stages 10 to 16 shown only in part in FIG. 1 are formed substantially rotationally symmetrically to the axis of rotation 20. For reasons of better clarity, only the respective left component of the corresponding elements are shown in FIG. 1 and the part in mirror symmetry with the axis of rotation 20 is not shown. The same applies to the flange 26 which defines a pump inlet 24, which is only shown schematically in FIG. 1, which surrounds the inlet region and which can likewise be formed substantially rotationally symmetrically to the axis of rotation 20.

The turbomolecular pump stage 10 arranged in the region of the pump inlet 24 includes a plurality of rotor disks 28 arranged at the rotor shaft 22, with in FIG. 1 only one rotor disk 28 being shown and a plurality of stator disks, not shown in FIG. 1, corresponding to the rotor disks 28. Furthermore a disk-shaped rotor hub 30 is attached to the shaft 22 and extends in a radial plane; an outer rotor member 32 associated with the molecular pump stages 12 and 14 and an inner rotor member 34 associated with the molecular pump stage 16 are arranged at said rotor hub and are supported by the hub 30. The molecular pump stages 12, 14, 16 are designed as Holweck stages. The rotor member 34 is in this respect arranged within the rotor member 32 and the rotor members 32, 34 are nested in one another.

The outer rotor member 32 is formed by a Holweck sleeve which has the form of a straight cylinder jacket oriented in the direction of the axis of rotation 20 and having a substantially constant wall thickness and with a straight radial outer surface 36 in the shape of a cylinder jacket and a straight radial inner surface 38 in the shape of a cylinder jacket. The outer surface 36 and the inner surface 38 each form the pump-active surface of one of the pump stages 12 and 14 and act in a pump-active manner with corresponding rotationally symmetrical Holweck stator sleeves 40, 42 in the shape of a cylinder jacket. The outer surface 36 of the rotor member 32 cooperates with an outer Holweck stator sleeve 40 which forms a narrow Holweck gap 39 with the rotor member 32 and at which a Holweck thread 41 is provided. The Holweck thread 41 has grooves which extend spirally in the direction of the axis of rotation 20 and which form flow channels for the gas. Such a Holweck thread 43 is also arranged at the outer side of the inner Holweck stator sleeve 42 and cooperates with the radial inner surface 38 of the outer rotor members 32 in a pump-active manner with which it forms a Holweck gap 39.

The radial outer surface 36 and inner surface 38 of the rotor member 32 are each formed as smooth surfaces and effect the pump effect of the respective pump stage together with the Holweck threads 41 or 43 of the stator sleeves 40, 42 arranged respectively opposite. In principle it would also be possible to provide the Holweck thread of one or both Holweck stages 12, 14 at the rotor member 32 and to form the corresponding surfaces of the stator sleeves 40, 42 as smooth. The same applies accordingly to the Holweck stage 16, i.e. its Holweck thread 57 can be arranged, as explained in the following, at the stator sleeve 42 or at the rotor member 34.

The inner rotor member 34 has a base part 44 attached to the rotor hub 30 and a support part 46 which is connected at the free axial end of the base part 44 to the base part 44 and at which the rotor elements 48 of the side channel pump stage 18 are arranged. The base part 44 has, corresponding to the outer rotor member 32, the shape of a straight cylinder jacket oriented in parallel to the axis of rotation 20 and having a constant wall thickness and having a radial outer surface 50 and a radial inner surface 52 respectively having the shape of a straight cylinder jacket. The radial outer surface 50 of the rotor member 34 in this respect forms the pump-active surface of the rotor member 34 and cooperates with the radial inner surface 55 of the Holweck stator sleeve 42. The inner surface 55 of the Holweck stator sleeve 42 has a Holweck thread 57 which will be explained more exactly in the following with respect to FIG. 2 and has flow channels through which the gas flows in the direction of the side channel pump stage 18 during operation of the pump. The support part 45 is likewise made in sleeve shape and substantially has the shape of a straight cylinder jacket oriented in parallel to the axis of rotation 20 and having a straight radial outer surface 54 and radial inner surface 56 in the shape of a cylinder jacket. The support part 46 is in this respect inserted into the base part 44 so that the radial outer surface 54 of the support part 46 areally contacts the radial inner surface 52 of the base part 44. The base part 44 and the support part 46 can be held at one another, for example, by a clamping effect present in the region of their mutual contact and caused, for example, by a shrinking process.

The support part 46 forms, as shown in FIG. 1, a step or overhang of the rotor member 34 projecting radially inwardly with respect to the base part 44. The radial inner surface of the rotor member 34 comprising the base part 44 and the support part 46 overall is thus formed by two longitudinal sections which follow one another in the direction of the rotor axis 20 and which each on their own have the shape of a straight cylinder jacket in parallel with the axis of rotation 20 and having an unchanging diameter. The radial inner surface of the rotor member 34 in a first longitudinal section is in this respect formed by the radial inner surface 52 of the base part 44 and defines a larger cylinder diameter and the radial inner surface of the rotor member 34 in a second longitudinal section is formed by the radial inner surface 56 of the support part 46 and defines a smaller cylinder diameter. The radial inner surface of the rotor member 34 bounds a free space 58 in which, for example, a drive unit of the vacuum pump not shown in FIG. 1 can be arranged.

The radial inner surface 56 of the support part 46 forms a dynamic seal or a dynamic sealing gap having an oppositely disposed static pump component as shown e.g. in FIG. 3. This seal or this sealing gap can contain any desired type of seal, for example a pumping seal which is in particular similar to a Holweck stage and/or which has a conveying direction directed out of the space 58 sealed by the seal.

The support part 46 has a support surface 60 facing in the axial direction at which the rotor elements 48 are arranged and from which the rotor elements 48 project in the axial direction. The rotor elements 48 are in this respect formed by vanes each having a vane surface facing in the direction of revolution and are arranged behind one another in a plane oriented perpendicular to the axis of rotation 20 along a ring revolving in circular form about the axis of rotation 20.

The side channel pump stage 18 furthermore includes a side channel stator 62 in which a side channel 46 is formed which is open in the axial direction in the present embodiment, which has a ring-shaped extent which corresponds to the ring-shaped arrangement of the rotor element 48 and in which the rotor elements 48 revolve. The side channel 64 is enlarged with respect to the rotor elements 48 over the large part of its longitudinal extent as is shown in FIG. 1. In the operation of the vacuum pump, the gas can be driven by the rotor vanes 48 in the longitudinal direction of the ring-shaped side channel 64 and simultaneously rotatingly about the longitudinal axis of the side channel 64 so that a spiral flow extent results with a plurality of spiral revolutions along a revolution in the side channel 64, whereby a high pressure difference is ensured between the inlet and the outlet of the side channel pump stage 18. The pumping principle of the side channel pump stage 18 also ensures a high and efficient pump effect in the high pressure range and in particular in the laminar flow range.

In the region of an outlet of the side channel pump stage 18, a so-called scraper of the side channel stator 62 is provided which effects a narrowing of the side channel 64 such that the cross-section of the side channel 64 in the narrowed region corresponds at least approximately to the cross-section of the rotor elements 48 and is only minimally expanded with respect thereto. The gas conveyed through the rotor elements 48 is thereby scraped off by the scraper and is urged into the outlet of the side channel pump stage 18. The outlet of the side channel pump stage 18 can be connected to a pump outlet of the vacuum pump which can, for example, comprise or include a small flange.

FIG. 2 shows the radial inner surface 55 of the inner Holweck stator sleeve 42 in a flattened view or a view projected into one plane. The Holweck stator sleeve 42 has a Holweck thread 57 which could in principle, however, also be arranged at the radial outer surface 50 of the rotor member 34 made smooth in the present embodiment. In this embodiment, the radial inner surface 55 of the Holweck stator sleeve 42 could be made substantially smooth.

The Holweck thread 57 includes two sections 66 and 68 following one another in the axial direction. A plurality of threaded projections 70 oriented toward the axis of rotation 20 and having thread channels 72 arranged therebetween which form flow channels (Holweck grooves) for the gas are formed in the section 66. The thread channels 72 open into a deepened collection region 74 which runs around the axis of rotation 20 in the peripheral direction and in which the gas conveyed through the thread channels 72 is collected. The collection region 74 opens into a supply channel 76 of the section 68 which is bounded by two areal elevated projections 78 and which leads to an inlet of the side channel pump stage 18. The gas conveyed substantially uniformly over the total periphery in the upper section 66 can in this manner be bundled in the supply channel 76 and directly supplied to an inlet of the side channel pump stage 18, whereby the pump efficiency in the side channel pump stage 18 is optimized. The above-described projections 70 and 78 can also be seen in the representation of FIG. 1, with the sectional plane of the representation of FIG. 1 corresponding to the dashed line 80 in FIG. 2.

In the Holweck thread 57 shown in FIG. 2, the section 68 or the channel 76 has a larger axial extent than the collection region 74. The section 68 or the channel 76 can, however, also have a smaller axial extent than the collection region 74 and/or than the section 66. In accordance with an embodiment, the elevated projections 78 of the region 68 have a larger construction height in the radial direction than the projections 70 of the section 66. A particular good sealing effect can thereby be achieved in the region of these projections 78 which bound the channel 76 by a particularly small clearance between the Holweck stator 42 and the rotor member 34 and gas losses at the transition between the Holweck stage 16 and the side channel pump stage 18 are minimized.

As shown in FIG. 1, a Holweck gap 39 is formed between the projections 70, 78 and the radial outer surface 50 of the rotor member 54 and, like the Holweck gap 39 of the pump stage 12 and 14 is shown exaggeratedly large in relation and is in reality selected so small that a high sealing effect is achieved between the projections 70, 78 and the oppositely disposed smooth surfaces of the rotor members 32, 34. The gas flows in this respect almost completely through the channels which are defined by the grooves of the Holweck threads 41, 43, 57.

The rough extent of the gas flow through the vacuum pump shown in FIG. 1 in the sectional plane of FIG. 1 is illustrated by a dashed arrow 84. As shown in FIG. 1, the gas first runs through the turbomolecular pump stage 10 after its entry through the pump inlet 24 and thereupon through the Holweck stages 12, 14 and 16, in this order, before the gas enters into the side channel pump stage 18 and is conveyed after passing through the side channel pump stage 18 to the pump outlet not shown in FIG. 1. An ideal pump effect and high pump efficiency of the vacuum pump is achieved by the cooperation of the pump stages 10 to 18 in all operating conditions and in particular also at high exit pressures and gas loads, with the vacuum pump simultaneously being able to be realized in a very small construction space.

FIG. 3 shows a vacuum pump in accordance with a further embodiment of the invention in an axial section which substantially corresponds to the vacuum pump shown in FIGS. 1 and 2. In this respect, additional components of the vacuum pump can be recognized in FIG. 3 which are not shown in FIG. 1 such as a plurality of rotor disks 28 and a stator disk 86 of the turbomolecular pump stage 10 arranged therebetween. Furthermore, a drive 88 of the vacuum pump is shown which is arranged within the rotor member 34 as well as a contactless seal 90 formed between the drive 8 and the rotor hub 30 and a rotary bearing 92 of the vacuum pump.

A pump housing 94 is equally shown which is connected to a gas outlet 95 of the side channel pump stage 18 as well as a tap 96 which is arranged upstream of the Holweck stage 12 and downstream of the turbomolecular stage 10 and via which gas can flow from outside the vacuum pump directly into the Holweck stage 12.

The projections (webs) of the Holweck threads 41, 43, 57 are shown in FIG. 3 so that its spiral shape is visible, just as the sense of rotation of the Holweck threads 41, 43, 57 alternating from Holweck stage 12, 14, 16 to Holweck stage 12, 14, 16 which corresponds to the alternating axial conveying direction from top to bottom or from bottom to top in FIG. 3. In the embodiment of FIG. 3, the number of Holweck channels of the Holweck threads 41, 43, 57 in the gas flow direction increases from Holweck stage to Holweck stage and the axial extent of the Holweck channels becomes correspondingly smaller. The pump behavior of the Holweck stages 12, 14 16 is thereby optimized. The Holweck thread 57 of the innermost Holweck stage 16 is formed homogeneous with Holweck channels extending over the total axial length of the Holweck stator sleeve 42 in the embodiment shown in FIG. 3, unlike the shape shown in FIG. 2. In principle, the Holweck thread 57 could, however, also be designed in the embodiment shown in FIG. 3 as is shown in FIG. 2 for the pump of FIG. 1.

The pump shown in FIG. 3 includes a support part 46 explained in more detail in the following with respect to FIG. 4 and a support sleeve which has a support surface 60 which is inclined by approximately 45° with respect to the axis of rotation 20, which has a frustoconical jacket shape, at which the vane-like rotor elements 48 are arranged and from which the rotor elements 48 project substantially perpendicular, i.e. at an angle of likewise approximately 45° to the axis of rotation. A scraper 98 of the side channel pump stage 18 is shown at the left hand side in FIG. 3 and serves for scraping off the gas driven in the side channel 64 and for its conveying to the pump outlet 94.

The rough gas flow extent from the pump inlet 24 to the pump outlet 94 is also illustrated in FIG. 3 by a dashed arrow 84 in the sectional plane of FIG. 3.

FIG. 4 and FIG. 5 each show further details of the support sleeve 46, with FIG. 4 showing a perspective representation of the support sleeve 46 with the rotor elements 48 enlarged with respect to FIG. 3 and FIG. 5 showing the support sleeve 46 in the axial section in the state installed at the base part 44.

The sleeve-shaped support part 46 includes a connection section 100 in the shape of a cylinder jacket whose radial outer surface 54 in the assembled state contacts the radial inner surface 52 of the base part 44 and is connected to the base part 44. The support sleeve 46 furthermore includes a connection section 100 at which the rotor elements 48 are arranged and which projects outwardly in the radial direction with respect to the connection section 100 so that the connection section 100 and the support section 102 form a substantially L-shaped cross-section shown in FIG. 5. The support section 102 in this respect is aligned in the assembled state with the radial outer surface 50 of the base part 44 as is the radially outwardly disposed outer edges of the rotor elements 48.

As shown in FIG. 4, the rotor elements 48 are formed as vanes which have a shape slightly inclined toward the rear against the direction of rotation in the axial direction and in the radial direction. A shape of the vanes 48 inclined to the front is also conceivable, but not shown. The support sleeve 46 preferably comprises a metallic material which contains e.g. aluminum or consists thereof, whereas the base part 44 formed as a Holweck sleeve can comprise a CRP material, for example.

As shown in FIG. 4, the support surface 60 of the support section 102 has a plurality of balancing bores 104 arranged distributed over the periphery of the support part 46 and having threads into which corresponding balancing weights can be screwed, and indeed preferably such that the screwed-in balancing weights are arranged completely countersunk in the balancing bores 104 and in particular terminate substantially flush with the support surface 60. The balancing bores 104 form a balancing plane of the vacuum pump oriented perpendicular to the axis of rotation 20.

FIG. 6 shows a vacuum pump in accordance with a further embodiment in the axial section. The vacuum pump includes a turbomolecular stage 10, which has a plurality of rotor disk 28, as well as two molecular pump stages 12, 14 formed as Holweck stages and a side channel pump stage 18 which follow one another in this order in the flow direction. The side channel pump stage 18 is arranged between the molecular pump stages 12, 14 and the pump inlet 24. The pump inlet 24, the side channel pump stage 18 and the molecular pump stages 12, 14 thus follow one another in this order in the direction of the axis of rotation 20 and the side channel pump stage 18 is arranged closer to the pump inlet 24 than the Holweck stages 12, 14 although it is connected after the Holweck stages 12, 14 with respect to the gas flow.

The rough gas flow extent through the pump in the sectional plane of FIG. 6 is illustrated in FIG. 6 by an arrow 84. The gas first enters via the pump inlet 24 into the turbomolecular stage 10 which is flowed through by the gas substantially axially, that is in parallel to the axis of rotation 20. A gas flow channel 106 shown schematically in FIG. 6 and arranged in the static part of the vacuum pump leads radially outwardly past the pump-active structure of the side channel pump stage 18 formed by the rotor elements 48' and the side channel 64' so that the gas moves past the side channel pump stage 18 into the Holweck stage 12. The Holweck stages 12 and 14 substantially correspond to the Holweck stages 12 and 14 explained above with respect to FIG. 1. The Holweck stages 12 and 14 include a common rotor member 32 which is arranged at a disk-shaped and substantially radially oriented rotor hub 30' and is formed as a straight Holweck sleeve oriented in the axial direction and having the shape of a cylinder jacket. The rotor member 32 accordingly has a radial outer surface 36 and a radial inner surface 38 which each have the shape of a straight, axial cylinder jacket and each form the pump-active surface of one of the Holweck stages 12, 14. These pump-active surfaces 36, 38 in this respect cooperate with Holweck stator sleeves 40, 42 (cf. FIG. 1) as shown in FIG. 1 and not shown separately in FIG. 6. The Holweck stator sleeves each have a Holweck thread with helical or spiral Holweck channels through which the gas is driven in a pumping manner at their cylindrical inner or outer sides facing the respective pump-active surface 36, 38 of the rotor member The gas first moves from the gas flow channel 106 into the Holweck stage 12 and flows downwardly through the Holweck stage 12 in the axial direction away from the pump inlet 24 and thereupon into the Holweck stage 14 in which it is conveyed upwardly in the axial direction in the direction toward the pump inlet 24. The two Holweck stages 12, 14 thus effect a reversal of direction of the flow direction of the gas and simultaneously a conveying of the gas from radially outwardly to radially inwardly. The rotor hub 30' has an axial aperture 108 at the end of the Holweck stage 14 facing the rotor hub 30', said aperture serving as a gas outlet of the Holweck stage 14 and as a gas inlet of the side channel pump stage 18 and via which the gas enters into a flow channel 110 of the side channel stator 62' leading into the side channel 64'. Only the left hand part of the side channel stator 62' is shown in FIG. 6 which is preferably formed rotationally symmetrically to the axis of rotation 20. A gap 112 which extends in the radial direction is formed between the rotor hub 30 and the side channel stator 62' and has a small axial extent to achieve a sealing effect between the rotor hub 30 and the side channel stator 62' and to ensure that the gas moves at least approximately completely from the aperture 108 into the flow channel 110. The rotor hub 30' preferably includes a plurality of apertures 108 distributed over its periphery as shown in FIG. 6. Equally, the side channel stator 62' can have a plurality of corresponding flow channels 110. The Holweck thread of the Holweck stage 14 can in principle be formed homogeneous with webs and Holweck channels extending over the whole axial length. The Holweck thread can also be designed, as shown in FIG. 2, to achieve a direct introduction of the gas into the inlet of the side channel pump. The Holweck thread not shown separately in FIG. 6 can in this respect be located at the Holweck stator, likewise not shown, or at the radial inner surface of the rotor member 32.

The pump-active structure of the side channel pump stage 18 is formed in principle as explained above with respect to FIG. 1. The side channel pump stage 18 includes vane-like rotor elements 48' which are arranged on a rotor hub 114 which is spaced apart from the rotor hub 30' of the Holweck stages 12, 14 in the axial direction. The rotor hub 114 is formed in disk form and extends in the radial direction. The rotor elements 48' project in the radial direction from the margin of the rotor hub 114 and into the side channel 64' open in the radial direction. A large diameter of the side channel pump stage 18 and a correspondingly good pumping effect is thereby achieved with a simultaneously compact structure of the pump. The pump shown in FIG. 6 can have a pump outlet at the axial level of the side channel pump stage 18 which is connected to an outlet of the side channel pump stage 18 and is surrounded, for example, by a small flange. In addition to the Holweck stages 12, 14, the pump shown in FIG. 6 could have still further Holweck stages connected in series with the Holweck stage 12, 14 and preferably arranged in one another in the radial direction.

The installation of the Holweck stator sleeves not shown in FIG. 6 is in this respect possible in a particularly simple manner since the axial end of the Holweck stages 12, 14 remote from the rotor hub 30' and shown at the bottom in FIG. 6 is freely accessible and the access is in particular not blocked by the side channel pump stage 18 so that a particularly simple and compact structure of the vacuum pump is achieved.

FIG. 7 shows a vacuum pump in accordance with a further embodiment of the invention in an axial section which substantially corresponds to the vacuum pump shown in FIG. 6.

The pump shown in FIG. 7 includes, in addition to the side channel pump stage 18, a plurality of molecular pump stages 12, 14, 116, 118 which are formed as Holweck stages and which include two rotor members 32 having the shape of a cylinder jacket and corresponding Holweck stator sleeves not shown in FIG. 7. The Holweck stages 12, 14, 116, 118 are in this respect each formed as described above with respect to FIG. 6. The side channel pump stage 18 is also arranged between the pump inlet 24 and the molecular pump stages 12, 14, 116, 118 formed as Holweck stages in the vacuum pump shown in FIG. 7.

The rotor elements 48 of the side channel pump stage 18 and the rotor members 32 of the Holweck stages 12, 14, 116, 118 are arranged on a 30 common rotor hub 30", with the rotor elements 48" projecting from the margin of the rotor hub 30" in the radial direction and beyond the radial extent of the rotor hub 30". The rotor elements 48 in this respect extend into the side channel 64 open in the radial direction and carry out a revolving movement about the axis of rotation 20 in it.

As indicated by the gas flow arrow 84 in FIG. 7, the gas enters via the pump inlet 24 into the turbomolecular stage 10 in operation of the pump and is there conveyed in the axial direction to the rotor hub 30. The rotor hub 30 has one or more axial apertures 120 which provide a gas flow path from the turbomolecular stage 10 radially inwardly past the pump-active structure of the side channel pump stage 16 into the Holweck stage 12 and represent a gas inlet for the Holweck stage 12. As described above with respect to the Holweck stages 12, 14 of the pump shown in FIG. 6, the gas is conveyed through the Holweck stages 12, 14, 116, 118 in the axial direction respectively twice from top to bottom and from bottom to top so that overall a reversal of direction of the gas flow direction is effected. In contrast to the embodiment shown in FIG. 6, the Holweck stages 12, 14, 116, 118 are, however, flowed through in the order from radially inwardly to radially outwardly so that a gas flow direction from radially inwardly to radially outwardly results. The gas enters at the end of the radially most outwardly disposed Holweck stage 118 facing the pump inlet 24 directly into the side channel pump stage 18 via a flow channel 122 of the side channel stator 62" which is arranged disposed opposite the margin of the rotor hub 30" in the radial direction. After passing through the side channel pump stage 18, the gas can move to a pump outlet which is preferably arranged at the axial level of the side channel pump stage 18.

Due to the arrangement of the Holweck sleeves 32 and of the rotor elements 48 of the side channel pump stage 18 on a common rotor hub 30", in the embodiment shown in FIG. 7, a construction shape is achieved which is extremely compact in the axial direction. However, a rotor hub 114 (see FIG. 6) separate from the rotor hub 40 could also be provided for the side channel pump stage 18. It could then optionally have apertures through which the gas can be conveyed radially inwardly past the pump-active structure of the side channel pump stage. In principle, the side channel pump stage 18 could also be radially outwardly flowed around, for example through a bypass channel 106 arranged in the housing of the vacuum pump (FIG. 6).

The end of the Holweck stages 12, 14, 116, 118 remote from the pump inlet 24 are also freely accessible in the pump shown in FIG. 7. The associated stator sleeves which are not shown in FIG. 7 can thus easily be arranged at an outer wall of the vacuum pump which is disposed opposite the free axial end of the rotor members 32.

REFERENCE NUMERAL LIST

10 turbomolecular pump stage
12, 14, 16 molecular pump stage
18 side channel pump stage
20 axis of rotation
22 rotor shaft
24 pump inlet
26 flange
28 rotor disk
30 rotor hub
32, 34 rotor member
36 radial outer surface
38 radial inner surface
39 Holweck gap
40, 42 Holweck stator sleeve
41, 43 Holweck thread
44 base part
46 support part, support sleeve
48 rotor elements
50, 54 radial outer surface
52, 55, 56 radial inner surface
57 Holweck thread
58 free space
60 support surface
62 side channel stator
64 side channel, stator channel
66, 68 section
70 threaded projection
72 thread channel
74 collection region
76 supply channel
78 projection
80 intersection line
84 arrow
86 stator disk
88 drive
90 seal
92 rotary bearing
94 pump outlet
95 gas outlet
96 tap
98 scraper
100 connection section
102 support section
104 balancing bore
106 gas flow path
108 aperture
110 flow channel
112 gap
114 rotor hub
116, 118, 16 molecular pump stage
120 aperture
122 flow channel

The invention claimed is:

1. A vacuum pump, comprising at least one molecular pump stage (12) which includes a rotor member (34) which forms a pump-active surface (50) of the molecular pump stage (12), and having at least one side channel pump stage (18) which is arranged downstream of the molecular pump stage (12) and which includes a plurality of rotor elements (48), wherein the rotor elements (48) of the at least one side channel pump stage (18) are supported by the rotor member (34) of the molecular pump stage (12), wherein the rotor member (34) includes a base which is substantially formed as a sleeve and extends from a rotor hub (40) supporting the rotor member (34) up to a support (46) of the rotor member (34) at which the rotor elements (48) are arranged.

2. A vacuum pump in accordance with claim 1, wherein the rotor elements (48) are arranged outside a region (58) enveloped by the rotor member (34).

3. A vacuum pump in accordance with claim 1, wherein the rotor member (34) is supported by a rotor hub (30).

4. A vacuum pump in accordance with claim 1, wherein the rotor elements (48) are at least one of arranged at a free axial end of the rotor member (34), project from the rotor member (34) in an axial direction and extend in an axial direction beyond the pump-active surface (50) of the rotor member (34).

5. A vacuum pump in accordance with claim 1, wherein the rotor member (34) includes a support (46) at which the rotor elements (48) are arranged.

6. A vacuum pump in accordance with claim 5, wherein the support (46) forms at least one of a free axial end, a step or overhang of the rotor member (34) projecting in a radial direction.

7. A vacuum pump in accordance with claim 1, wherein at least one of the rotor member (34) and a support (46) of the rotor member (34) at which the rotor elements (48) are arranged is formed substantially as a sleeve.

8. A vacuum pump in accordance with claim 1, wherein the rotor member (34) is made in multiple parts, with a base (44) which is supported by a rotor hub (30) and a support (46) at which the rotor 20 elements (48) are arranged each forming a part of the rotor member (34).

9. A vacuum pump in accordance with claim 1, wherein the molecular pump stage (12) includes an upstream first section (66) and a downstream second section (68) leading to the at least one side channel pump stage (18), wherein at least one of a smaller number of flow channels (72, 76) is formed in the second section than in the first section (66) and a balancing plane is provided which is arranged in the region of a support (46) of the rotor member (34) supporting the rotor elements (48).

10. A vacuum pump, comprising at least one molecular pump stage (12, 14, 116, 118), and at least one side channel pump stage (18) which is arranged downstream of the at least one molecular pump stage and which includes a plurality of rotor elements (48), with the at least one side channel pump stage (18) being arranged between a pump inlet (24) and the, at least one molecular pump stage (12, 14, 116, 118), wherein a gas flow path leading from the at least one molecular pump stage (12, 14, 116, 118) into the at least one side channel pump stage extends through one or more openings (108) of a rotor hub (30) supporting a rotor member (32) of the at least one molecular pump stage (12, 14, 116, 118).

11. A vacuum pump in accordance with claim 10, wherein a gas flow path leads from the pump inlet (24) at least one of radially inwardly and radially outwardly past the pump-active structure of the at least one side channel pump stage (18) into the at least one molecular pump stage (12, 14, 116, 118).

12. A vacuum pump in accordance with claim 11, wherein at least one of the gas flow path extends through one or more openings (120) of a rotor hub (30, 114) supporting the rotor elements (48) and the rotor hub (30, 114) is of disk shape.

13. A vacuum pump in accordance with claim 10, wherein the rotor elements (48) of the at least one side channel pump stage (18) are supported by a rotor hub (30, 114).

14. A vacuum pump in accordance with claim 13, wherein the rotor elements (48) of the at least one side channel pump stage (18) are arranged in a region of a radial outer side of the rotor hub (30, 114).

15. A pump in accordance with claim 14, wherein the rotor elements (48) project from a margin of the rotor hub (30, 114).

16. A vacuum pump in accordance with claim 10, wherein a rotor member (32) of the at least one molecular pump stage (12, 14, 116, 118) which forms the pump-active surface of the at least one molecular pump stage (12, 14, 116, 118) and the rotor elements (48) of the at least one side channel pump stage (18) are supported by a common rotor hub (30).

17. A vacuum pump in accordance with claim 10, wherein at least one of a plurality of molecular pump stages (12, 14, 116, 118) are provided arranged behind one another via which a gas flow path leads from radially inwardly to radially outwardly or from radially outwardly to radially inwardly and at least one further pump stage (10) is provided arranged upstream of the at least one molecular pump stage.

18. A vacuum pump in accordance with claim 17, wherein the at least one side channel pump stage (18) is arranged between the further pump stage (10) and the molecular pump stage (12, 14, 116, 118) when the at least one further pump stage is provided.

* * * * *